United States Patent [19]

Hunn

[11] 4,326,094

[45] Apr. 20, 1982

[54] WATERPROOFING OF INSULATED ELECTRIC CABLES

[75] Inventor: Reginald A. Hunn, Natal, South Africa

[73] Assignee: South African Inventions Development Corporation, Pretoria, South Africa

[21] Appl. No.: 95,357

[22] Filed: Nov. 19, 1979

[30] Foreign Application Priority Data

Nov. 22, 1978 [ZA] South Africa ..... 78/6576

[51] Int. Cl.[3] ..... H01B 11/02

[52] U.S. Cl. ..... 174/23 R; 174/22 R; 174/23 C; 174/116

[58] Field of Search ..... 174/23 R, 23 C, 116, 174/22 R, 22 C

[56] References Cited

U.S. PATENT DOCUMENTS

| | | | |
|---|---|---|---|
| 437,330 | 9/1890 | Brooks, Jr. | 174/23 R |
| 2,362,963 | 11/1944 | Lee | 174/23 C |
| 2,507,508 | 5/1950 | Elliott et al. | 174/23 C X |
| 3,347,974 | 10/1967 | Arendt et al. | 174/23 R |
| 3,538,235 | 11/1970 | Arendt et al. | 174/23 C |
| 3,803,339 | 4/1974 | Speekman | 174/23 C |
| 3,999,003 | 12/1976 | Chevrolet et al. | 174/23 R |
| 4,004,077 | 1/1977 | Woytiuk | 174/23 C |

FOREIGN PATENT DOCUMENTS

| | | | |
|---|---|---|---|
| 2020741 | 11/1971 | Fed. Rep. of Germany | 174/23 R |
| 7601435 | 8/1976 | Netherlands | 174/23 C |
| 504720 | 4/1939 | United Kingdom | 174/23 C |
| 520999 | 5/1940 | United Kingdom | 174/23 C |
| 1505830 | 3/1978 | United Kingdom | 174/23 C |

*Primary Examiner*—Volodymyr Y. Mayewsky
*Attorney, Agent, or Firm*—Murray and Whisenhunt

[57] ABSTRACT

The invention provides for the waterproofing of a telephone cable by the incorporation of longitudinal strands within the sheath alongside the insulated conductors. The strands have deposited thereon a moisture sensitive swelling agent, such as ethyl hydrogen cellulose, and in the event of the sheath rupturing and the conductors being exposed to moisture the swelling agent on the strands reacts with the moisture rapidly forming a plug which prevents further ingress of the moisture.

17 Claims, 6 Drawing Figures

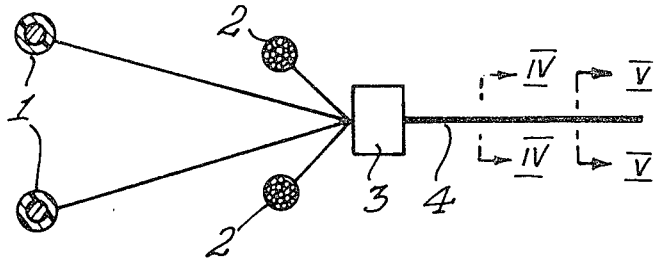
Fig 1.
Fig 2.
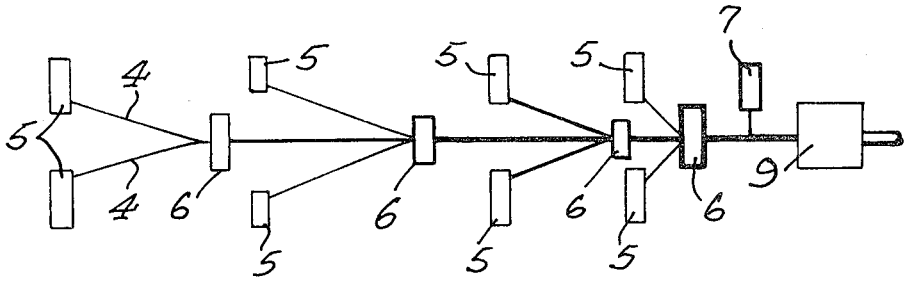
Fig 3.
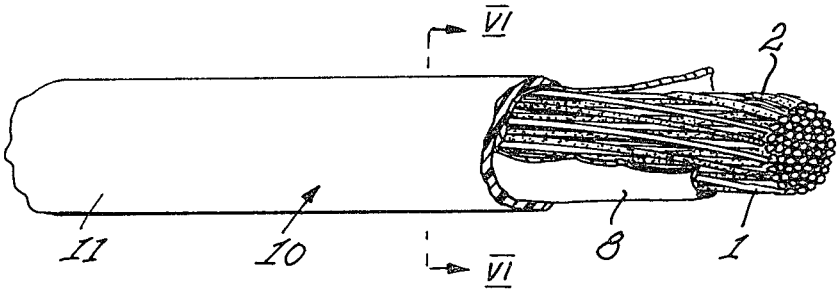

WATERPROOFING OF INSULATED ELECTRIC CABLES

FIELD OF THE INVENTION

This invention relates to the waterproofing of insulated electric cables particularly plastic insulated cables.

BACKGROUND OF THE INVENTION

The ingress of moisture into the interstices of an electric cable consisting of a multiplicity of plastic insulated conductors poses a serious problem. Depending on the type of core involved and the construction of the cable it disrupts transmission characteristics to different degrees and can result in some cases in complete failure of the cable. There are a number of mechanisms by which water can enter such a cable, sheath and joint failure being but two examples.

Once inside the sheath water can create a variety of effects. In general water entering a pulp and/or paper insulated cable will result in short circuits occurring between the conductors. However, the phenomenon of swelling of the paper or pulp tends to prevent further penetration along the core, thus localising the fault. In air core plastic insulated cable the water is free to travel by capillary action along the cable interstices and can result in large capacitance increases.

DESCRIPTION OF THE PRIOR ART

Various methods have been suggested to prevent water penetration, for example, it has been proposed to fill the interstices of the cable with a powder, (such as polyacrylamide or gelatine), which will swell when it becomes wet. It has also been proposed to add fillers to these materials, thus precipitated chalk (calcium carbonate) has been proposed for use with polyacrylamide. However, the most common practice to date is to fill the interstitial spaces within the cable with a petroleum jelly thus barring the entrance of water. There are, however, inherent problems associated with the introduction of this product, for example, it is essential to ensure that there is a minimum of interaction between the petroleum jelly and the plastics insulation under all conditions liable to be encountered by the finished cable on storage or in service. To maintain the low loss characteristics of the plastic insulated cable, either significantly larger diameters are necessary to offset the increase in permitivity due to the displacement of air by the filling medium or the plastic insulation needs to be produced in a cellular form. It is necessary to design the filling medium to provide satisfactory physical characteristics for the storage and service conditions of the cable which are liable to be encountered. For example a filling material which is too viscous at low temperatures could create problems in laying while a material which is suitably mobile at low temperatures could have unsatisfactory flow characteristics if localised areas of high temperatures are encountered as could be the case with aerial cables.

Handling of the filled cable is more involved than with its unfilled counterpart and requires a more complex splicing technique.

SUMMARY OF THE INVENTION

It is an object of the invention to provide for waterproofing of insulated electric cables in a manner which minimises difficulties associated with current techniques.

According to the invention an electric cable of the kind including a plurality of separately insulated conductors located within a sheath is characterised in the provision of strand material within the sheath, the strand material constituting a carrier for an adjuvant incorporating a moisture sensitive swelling agent.

In the event of moisture finding its way through the cable sheath the swelling agent reacts with the moisture, expands, and effectively seals off the leak. The swelling agent may be any suitable solid which is capable of absorbing free moisture to cause its own expansion in volume, for example, the swelling agent may be selected from the class comprising substituted celluloses including hydroxy ethyl cellulose, carboxy methyl cellulose, hydroxy propyl methyl cellulose, sodium carboxy methyl cellulose, synthetic resins such as various polyacrylates and polyvinyl alcohols, alginates, chalk, gelatine, cross-linked dextrins and starch derivatives. It will be realised however that other suitable materials, singly or in combination, may be used.

Also according to the invention the electric cable is further characterised in that the adjuvant deposited upon the strand material incorporates a wetting agent in addition to the swelling agent.

By the incorporation of a wetting agent re-wetting of the strand treated with the swelling agent is facilitated. It has been found that whereas a leaking cable will close by the formation of a plug of certain length in a cable incorporating a strand with swelling agent thereon, when a wetting agent is added the plug length which forms to close the leak is little more than one half the plug length which forms without the wetting agent. Thus the wetting agent causes more rapid wetting and swelling of the strand within the cable and corresponding quicker sealing.

The wetting agent may comprise any suitable non-ionic, anionic or cationic surface active agent such as an ethyoxylated nonyl phenol, dodecylbenzene sulphonate or quarternary ammonium compound. It is necessary to establish that the wetting agent selected is compatible with the swelling agent used, for example, an anionic wetting agent may not be compatible with a swelling agent having strong cationic properties.

The rate of swelling of some swelling agents, for example, the substituted cellulose types, is further enhanced if the pH of the swelling agent solution is raised to 9.0 or above by adding any suitable alkali such as sodium carbonate or caustic soda.

Preferably the adjuvant also incorporates a finely divided filler material and such filler material may constitute a carrier for the swelling agent by acting as an absorbent or an adsorbent for such swelling agent. The preferred filler is calcium carbonate. Such calcium carbonate should have an average particle size of 15 microns or less as particles of larger size result in a rough coating of the swelling agent upon the strand material.

The carrier strand material may be a natural product such as a cotton or wool thread or it may be a synthetic material such as a polyester fibre, and the swelling agent may be impregnated into and/or coated onto the strand.

In order to deposit the swelling agent upon the strand material an aqueous solution may be made up of the swelling agent, filler material and wetting agent, and the strand material may be drawn through a bath containing the aqueous solution, whereafter the strand may be dried in an oven or by passage between infra-red radiant heaters or other suitable heating means.

A single pass of the strand material through the adjuvant solution may not deposit sufficient swelling agent thereon and, if necessary, a strand emanating from the drying station can be passed back to the adjuvant bath for a further one or more passes therethrough. The solution of adjuvant may be prepared by initially dispersing the calcium carbonate in water utilising a mixer providing high sheer conditions and depositing in this slurry a fully digested aqueous solution of swelling and wetting agents. Alternatively the calcium carbonate dispersion can be added to the fully digested solution of swelling and wetting agents.

The wetting agent facilitates absorbtion of the swelling agent onto the filler and, provided the filler particles are 15 microns and less, a smooth, uniform paste is obtained which provides an effective and smooth coating on the strand material passed therethrough.

Glycerine or other plasticiser material may also be added to the aqueous adjuvant composition in order to achieve a thread which is sufficiently flexible to allow it to be bent and twisted when incorporated in a cable without shedding the swelling agent deposited thereon.

In a preferred arrangement the carrier strand material is simply laid down lengthwise together with the insulated conductors. Preferably the strands are incorporated into the interstices between the insulated conductors. The cable according to the invention will normally incorporate several strands which have swelling agent deposited thereon, the strands being twisted into the interstices between insulated conductors when the cable is laid down prior to the location of a sheath around the conductors.

An alternative arrangement provides for the winding of a carrier strand around one or more insulated conductors and in a further alternative carrier strands are simply packed in random fashion into the sheath so that a mass of strand material is incorporated into the sheath along with the insulated conductors. By depositing a swelling agent upon a carrier in the nature of a thread the construction of the cable is greatly facilitated. Also the physical characteristics of the cable in regard to its ability to bend are substantially unchanged. Furthermore it is unnecessary to provide special sealing means when forming joints with the cable.

Where the adjuvant includes a biodegradable material such as starch or gelatine, a fungicide or similar biocidal material such as sodium pentachlorophenate should be incorporated into the material deposited upon the carrier. It is also of advantage to incorporate a dye with the swelling agent as an indicator that the carrier had been properly coated or impregnated.

The invention also includes within its scope an aqueous swelling agent suitable for deposition upon strand material to be incorporated within an electric cable, and the strand material treated with the said swelling agent.

EXAMPLE

In order to illustrate the invention an example is described below:

A bath of adjuvant material was prepared comprising:

1300 parts of water
715 parts of Glycerine
105 parts of Precipitated Chalk
30 parts of Ethyl Hydrogen Cellulose
7.5 parts of Ethoxylated nonylphenol Through this was passed a rayon thread of 0.8 mm diameter in an uncompressed state. The thread was drawn along a tortuous path within the bath in order to provide the thread along its entire length with sufficient retention time in the bath to impregnate the thread.

The thread was then dried in hot air having an input temperature of 145° C., so driving off the water and leaving the particulate adjuvant in form of cellulose swelling agent, chalk filler, glycerine plasticiser and ethoxylated nonyl phenol wetting agent deposited upon the thread fibres throughout the body of the thread.

It was found that this thread when dried was reasonably flexible and little dusting occurred on handling. During the drying process care was exercised not to heat the thread above 125° C.

If desired a trace of dye such as fluorescin could be incorporated into the adjuvant to monitor the coating of the thread.

Approximately 8 kilometers of strand material treated in the above way was prepared from which 200 meters of 20 pair telephone cable in accordance with the invention was made.

The telephone cable was made by twinning two insulated conductors together with two coated strands so that the latter ran parallel to the conductors in the helical interstices defined on each side of the contact zone of the two conductors.

The conductors were made of 0.5 mm diameter copper wire insulated with polyethylene to give an overall diameter of 0.92 mm.

In all twenty twinned pairs were made as described above and these were taken up onto twenty bobbins. The bobbins were loaded onto a strander for stranding the pairs into a concentric formation which was bound with a dry kraft paper tape lapped 10%. The paper was not itself treated but could, if so desired, be coated with the adjuvant in the same way as the strand material. The coated wrapping would enhance the moisture sealing effect of the invention.

The bound assembly was then passed to a sheathing extruder which applied a black polyethylene sheath of 1,0 mm minimum thickness.

The above telephone cable of the invention was subjected to high voltage withstand testing and found to be value of 65 nF per kilometer as compared with an equivalent untreated cable which has an average pair capacitance of 53 nF. The 22% increase in capacitance could be adjusted by known methods including the use of cellular plastic insulation.

While the maximum acceptable level of capacitance on balance between pairs for telephone cables is 500 pF per 500 meters of cable length, the cable of the example was found to have a maximum capacitance on balance of 152 pF per 500 meters, thus being well within the maximum specification level.

The cable was then subjected to a standard water penetration test.

A circumferential portion of sheath and paper wrapping 25 mm wide was removed from the middle of a 2 meter length of cable and a watertight gland was applied over the exposed core so as to bridge the gap in the sheath. The cable was supported horizontally and a 1 meter head of water, containing a sufficient quantity of water soluble fluorescent dye for the detection of seepage, was applied to the core for 14 days at a temperature of 20°±5° C.

The sheath was then removed, the core carefully dissected and examined under ultraviolet light for water penetration. The water penetration should not exceed 850 mm in either direction and was in fact found to be blocked within 150 mm in either direction. The cable thus proved to be highly effectively waterproofed.

Paper and natural or synthetic fibre mat tapes such as those used in current cable constructions for binding the segregating units of conductors and for identification purposes have also been passed through the adjuvant solution and dried under the same conditions. These tapes have also exhibited similar swelling characteristics within the cable to prevent further penetration of water.

The invention is illustrated with reference to the accompanying drawings in which:

FIG. 1 is a diagrammatic flow sheet illustrating the twinning together of a pair of insulated conductors with a pair of strands upon or into which adjuvant material incorporating a swelling agent as described above has been deposited;

FIG. 2 is a diagrammatic flow sheet of a stranding machine illustrating the stranding together of a series of conductor and strand pairs of the kind produced according to FIG. 1;

FIG. 3 is a perspective view with parts broken away illustrating a transmission cable according to the invention;

Figure 4:
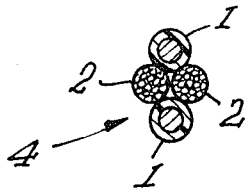
FIG. 4 is a section on the line IV—IV in FIG. 1.
Figure 5:
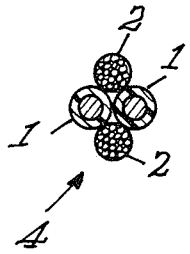
FIG. 5 is a section on the line V—V in FIG. 1.
Figure 6:
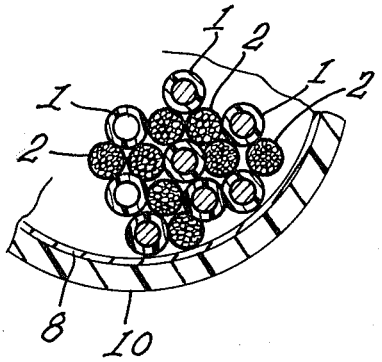
FIG. 6 is a partial section on the line VI—VI in FIG. 3.

Referring to the drawings polyethylene insulated conductors 1 for the production of a transmission cable are introduced together with adjuvant coated strands 2, as described in the above example, to a twinning machine 3 for the production of a paired conductor length 4 having the coated strand material 2 extending helically together with the conductors 1. The cross-sectional disposition of the conductors 1 and strands 2 may at random be that as illustrated in FIG. 4 or that as illustrated in FIG. 5. Reels 5 of lengths of the paired conductors 4 are introduced to stranding stations 6 to produce the required number of conductors stranded together and provided in the interstices between the insulated conductors 1 with adjuvant coated strands 2 containing moisture swellable material, such strands extending helically together with the conductors 1 in the interstices therebetween.

The final group of conductors and strands is passed to a paper wrapping station 7 for providing a paper wrapping 8 therearound and finally to a polyethylene sheating station 9 for the production of a polyethylene sheath 10, thereby providing the waterproofed electrical cable 11 of the invention.

I claim:

1. An electric cable comprising an exterior sheath, a plurality of twinned, stranded insulated conductors having helical interstices associated therewith located within said sheath, a plurality of strand material carrier elements located in said helical interstices and extending along the entire length of said cable, said strand material carrier elements having deposited thereon an adjuvant incorporating a moisture sensitive swelling agent, said swelling agent reacting with any moisture leaking into said sheath to seal off the leak, the physical bending characteristics of said cable remaining substantially unchanged by the incorporation of said strand material carrier elements therein.

2. The electric cable of claim 1 in which there is a separate carrier strand for each insulated conductor.

3. The electric cable of claim 1 or claim 2 in which the adjuvant is deposited along the entire length of the strand material.

4. The electric cable of claim 1 or claim 2 in which the adjuvant deposited upon the strand material includes one or more swelling agent compounds selected from the class comprising substituted celluloses including hydroxy ethyl cellulose, carboxy methyl cellulose, hydroxy propyl methyl cellulose, sodium carboxy methyl cellulose, hydrophilic synthetic resins, alginates, chalk, gelatine, cross-linked dextrins and starch derivatives.

5. The electric cable of claim 1 or claim 4 in which the adjuvant deposited upon the strand material incorporates a wetting agent.

6. The electric cable of claim 5 in which the wetting agent is selected from the class comprising non-ionic, anionic and cationic surface active agents.

7. The electric cable of claim 5 in which the wetting agent is selected from the group comprising ethoxylated nonyl phenol, dodecylbenzene sulphonate and a quarternary ammonium compound.

8. The electric cable of claim 1 in which the adjuvant deposited upon the strand material incorporates a filler material.

9. The electric cable of claim 8 in which the filler material is calcium carbonate.

10. The electric cable of claim 9 in which the calcium carbonate has an average particle size of 15 microns or less.

11. The electric cable of claim 1 or claim 4 in which the adjuvant deposited upon the strand material incorporates a plasticiser material.

12. The electric cable of claim 11 in which the plasticiser is glycerine.

13. The electric cable of claim 1 or claim 4 in which the strand material comprises a fibrilated synthetic fibre.

14. An electric cable of claim 2 in which the cable comprises a telephone cable.

15. The electric cable of any one of claims 8 to 10 in which the moisture sensitive swelling agent is absorbed by the filler material.

16. The electric cable of any one of claims 8 to 10 in which the moisture sensitive swelling agent is adsorbed by the filler material.

17. Electric cable of claim 1, wherein said cable is telephone cable.

* * * * *